US011472173B2

(12) United States Patent
Miyoshi et al.

(10) Patent No.: US 11,472,173 B2
(45) Date of Patent: Oct. 18, 2022

(54) PROCESSING SYSTEM AND CONTROL METHOD FOR HANDLING CONTINUOUS SHEET OF MATERIAL

(71) Applicants: SUMITOMO HEAVY INDUSTRIES, LTD., Tokyo (JP); ASAHI KASEI KABUSHIKI KAISHA, Tokyo (JP)

(72) Inventors: Kiyoto Miyoshi, Yokosuka (JP); Takatora Ando, Yokosuka (JP); Keita Suzuki, Tokyo (JP); Shinya Matsubara, Tokyo (JP); Taishi Hitomi, Tokyo (JP); Makoto Ikeda, Tokyo (JP)

(73) Assignees: SUMITOMO HEAVY INDUSTRIES, LTD., Tokyo (JP); ASAHI KASEI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/823,283

(22) Filed: Mar. 18, 2020

(65) Prior Publication Data

US 2020/0215814 A1 Jul. 9, 2020

Related U.S. Application Data

(63) Continuation of application No. PCT/JP2018/028108, filed on Jul. 26, 2018.

(30) Foreign Application Priority Data

Sep. 19, 2017 (JP) ..... JP2017-179298

(51) Int. Cl.

| | |
|---|---|
| ***B41F 13/02*** | (2006.01) |
| ***B65H 23/04*** | (2006.01) |
| ***B41F 27/12*** | (2006.01) |
| ***B41F 3/06*** | (2006.01) |
| ***B41F 3/56*** | (2006.01) |
| ***B41F 9/00*** | (2006.01) |
| ***B65H 23/188*** | (2006.01) |
| *B41F 3/36* | (2006.01) |

(52) U.S. Cl.

CPC ..... *B41F 27/1237* (2013.01); *B41F 3/06* (2013.01); *B41F 3/56* (2013.01); *B41F 9/003* (2013.01);

(Continued)

(58) Field of Classification Search

CPC ..... B41F 9/003; B41F 13/02; B41F 13/025; B41F 33/00; B41F 33/06; B41F 33/14;

(Continued)

(56) References Cited

U.S. PATENT DOCUMENTS 1,265,328 A * 5/1918 Henderson ..... B65H 23/1888 226/42
3,594,552 A * 7/1971 Adamson ..... B26D 5/34 377/18

(Continued)

FOREIGN PATENT DOCUMENTS

DE 102007049670 A1 4/2009
EP 2524806 A1 11/2012

(Continued)

OTHER PUBLICATIONS

English language translation of JP 2010-094947, publication date Apr. 30, 2010. (Year: 2010).*

*Primary Examiner* — Leslie J Evanisko
(74) *Attorney, Agent, or Firm* — HEA Law PLLC

(57) ABSTRACT

A web processing system which includes two rollers configured to rotate at the same phase while being in contact with a web which continuously exists along a movement passage and a suppressing mechanism for suppressing a tension variation of the web between the two rollers.

7 Claims, 4 Drawing Sheets

(52) U.S. Cl.
CPC ..... *B65H 23/044* (2013.01); *B65H 23/048* (2013.01); *B65H 23/1888* (2013.01); *B41F 3/36* (2013.01); *B41F 13/02* (2013.01)

(58) Field of Classification Search
CPC .. B65H 23/00; B65H 23/1888; B65H 23/188; B65H 26/04; B65H 2511/112; B41P 2233/13
USPC ..... 101/156, 219, DIG. 42; 226/42, 44, 24
See application file for complete search history.

(56) References Cited

U.S. PATENT DOCUMENTS 3,806,012 A * 4/1974 Roch ..... B65H 23/1882 226/2
3,905,533 A * 9/1975 Corse ..... B65H 23/16 226/44
4,214,524 A 7/1980 Corse
5,602,747 A * 2/1997 Rajala ..... B65H 23/048 226/44
7,798,382 B2 9/2010 Zentgraf et al.
8,027,747 B2 9/2011 Schnabel et al.
2012/0294662 A1 11/2012 Schnabel et al.

FOREIGN PATENT DOCUMENTS

JP S5239410 A 3/1977
JP S56131012 A 10/1981
JP H0223143 A 1/1990
JP 2007145607 A 6/2007
JP 2008055707 A 3/2008
JP 2010094947 A 4/2010
JP 2013123916 A 6/2013
JP 2013173598 A 9/2013

* cited by examiner

PROCESSING SYSTEM AND CONTROL METHOD FOR HANDLING CONTINUOUS SHEET OF MATERIAL

RELATED APPLICATIONS

The contents of Japanese Patent Application No. 2017-179298, and of International Patent Application No. PCT/JP2018/028108, on the basis of each of which priority benefits are claimed in an accompanying application data sheet, are in their entirety incorporated herein by reference.

BACKGROUND

Technical Field

Certain embodiments of the present invention relate to a web processing system and a control method.

Description of Related Art

There is a printing system as an example of a web processing system. The printing system executes printing processing onto a long object (web) which continuously exists along a movement passage, such as paper and a film. A printing system disclosed in the related art is proposed.

The printing system is applied to, for example, Printed Electronics (PE), and higher-precision printing is required.

SUMMARY

According to an aspect of the present invention, there is provided a web processing system including two rollers configured to rotate at the same phase while being in contact with a web which continuously exists along a movement passage and a suppressing mechanism for suppressing a tension variation of the web between the two rollers.

Another aspect of the present invention is a control method. The method is a control method of a web processing system including two rollers that are configured to rotate at the same phase while being in contact with a web which continuously exists along a movement passage and a dancer system that includes a dancer roller disposed between the rollers. The method includes a step of rotating the two rollers at the same phase in a state where the dancer roller is controlled to be kept at a certain position and detecting a force applied to the web between the two rollers and a step of rotating the two rollers at the same phase in a state where a force applied to the dancer roller is controlled based on the detected force.

Any combination of the components, or a configuration where the components or expressions of the present invention are mutually substituted between methods, devices, systems is also effective as an aspect of the present invention.

DETAILED DESCRIPTION

A web flutters in some cases due to disturbance such as vibration of a drive motor of a rotating body rotating while being in contact with the web and wind. The fluttering of the web hinders higher-precision printing.

Such a phenomenon is not limited to the printing system, and can occur even in other types of web processing systems.

The present invention is devised in view of such circumstances, and it is desirable to provide a technique for realizing a higher-precision web processing system.

Hereinafter, the same or equivalent components, members, and processes, which are shown in each drawing, will be assigned with the same reference signs, and overlapping description thereof will be omitted as appropriate. Dimensions of members in each drawing are enlarged or reduced as appropriate for easy understanding. In addition, each drawing will be shown with some of members that are not important in describing an embodiment omitted.

Figure 1:
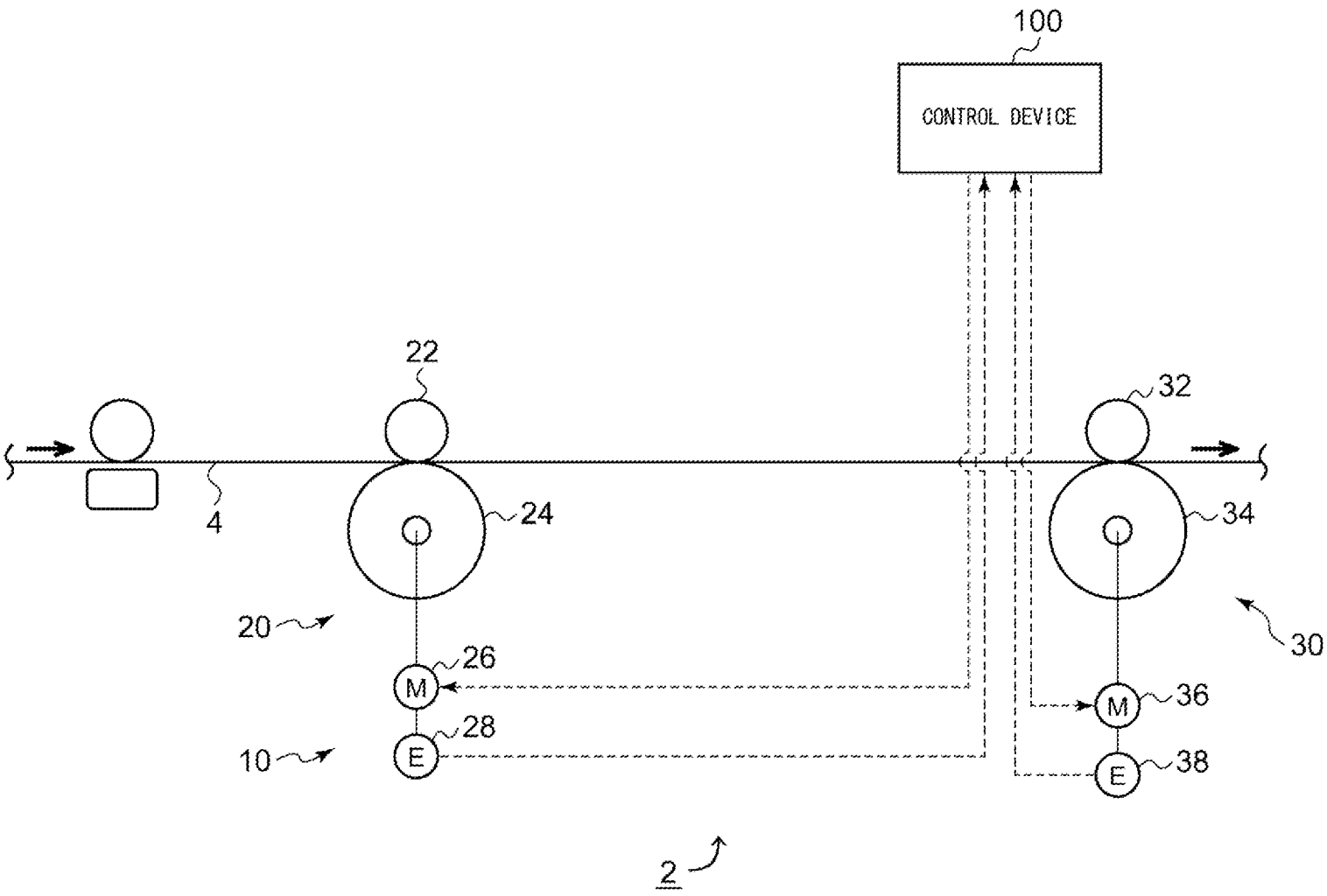
FIG. 1 is a schematic view illustrating a configuration of a general web processing system of the related art.

First, a web processing system 2 of the related art will be described. FIG. 1 is a schematic view illustrating a configuration of the web processing system 2 of the related art. Herein, the web processing system 2 is a multicolor printing system, and moves a web 4 along a predetermined movement passage, and executes printing onto the moving web 4. The web 4 is a band-like or sheet-like base material such as paper and a film, and continuously exists along the movement passage.

The web processing system 2 includes a printing device 10 that executes printing onto the web 4 and a control device 100 that controls the printing device 10. The printing device 10 is an intaglio (gravure) printing device in the embodiment. The printing device 10 includes a first printing unit 20 and a second printing unit 30. The first printing unit 20 is provided on an upstream side of the second printing unit 30 in a transport direction of the web 4.

The first printing unit 20 includes a first impression cylinder 22, a first plate cylinder 24, a first drive motor 26, and a first encoder 28. The first impression cylinder 22 presses the web 4 against the first plate cylinder 24. The first plate cylinder 24 prints a print pattern corresponding to a plate formed in an outer peripheral surface thereof onto the web 4. The first drive motor 26 rotation-drives the first plate cylinder 24. The first encoder 28 is provided on a machine shaft of the first drive motor 26, and measures a rotation angle from a reference position of the first plate cylinder 24 to output the measured value at a predetermined cycle to the control device 100.

The second printing unit 30 includes a second impression cylinder 32, a second plate cylinder 34, a second drive motor 36, and a second encoder 38. The second impression cylinder 32, the second plate cylinder 34, the second drive motor 36, and the second encoder 38 are configured the same as the first impression cylinder 22, the first plate cylinder 24, the first drive motor 26, and the first encoder 28, respectively.

The control device 100 controls the first drive motor 26 and the second drive motor 36 based on the output from the encoders. In particular, the control device 100 controls the first drive motor 26 and the second drive motor 36 such that the first plate cylinder 24 and the second plate cylinder 34 are in synchronization with each other and the first plate cylinder 24 and the second plate cylinder 34 rotate at the same phase. Hereinafter, such control is also called "phase control". Accordingly, a print pattern printed by the first plate cylinder 24 and a print pattern printed by the second plate cylinder 34 overlap each other.

However, in a web processing system of the related art such as the web processing system 2 of FIG. 1, in general, tension of the web 4 between the plate cylinders configured to rotate at the same phase is not controlled. Therefore, in a case where the web 4 between the plate cylinders flutters due to disturbance, such as vibration of the drive motor and wind, and tension variations occur in the web 4 between the plate cylinders, the tension variations cannot be suppressed. The present inventors have found out that it is necessary to suppress tension variations based on such disturbance for higher-precision printing. Thus, the present inventors have come up with providing a tension suppressing mechanism for suppressing tension variations of the web between the two plate cylinders configured to rotate at the same phase. Hereinafter, details will be described.

Figure 2:
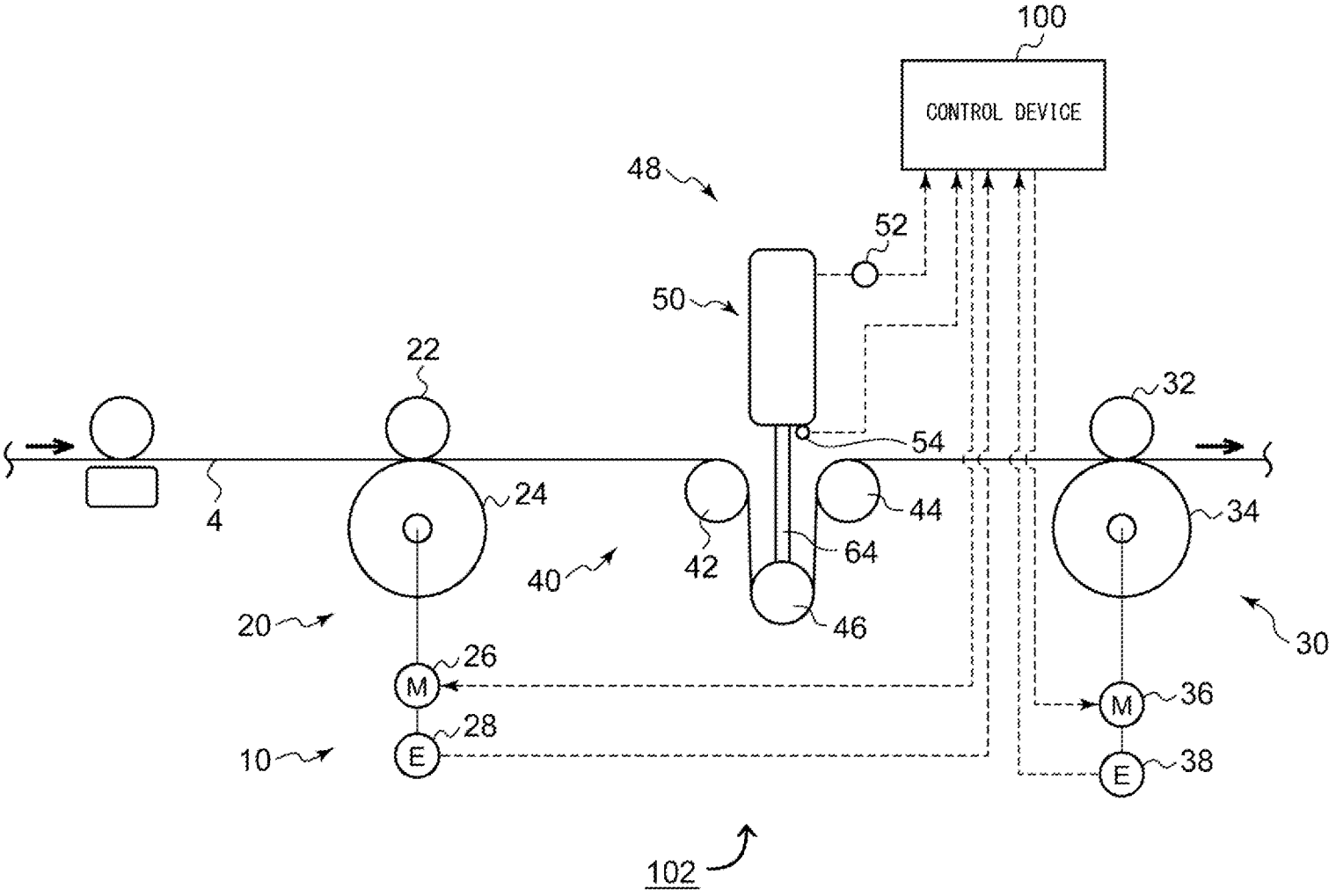
FIG. 2 is a schematic view illustrating a configuration of a web processing system according to an embodiment.

FIG. 2 is a schematic view illustrating a configuration of a web processing system 102 according to the embodiment. Description focused on differences from FIG. 1 will be made.

The printing device 10 includes a dancer system 40, which is a tension variation suppressing mechanism. The dancer system 40 includes a first guide roller 42, a second guide roller 44, a dancer roller 46, and an actuator device 48. In addition, also a pressure control unit 134, a position control unit 135, a pressure information recording unit 136, and a reference pressure maintaining unit 142 (all of which will be described later) of the control device 100 configure a part of the dancer system 40.

The first guide roller 42, the second guide roller 44, and the dancer roller 46 are disposed between the first plate cylinder 24 and the second plate cylinder 34. The first guide roller 42 is positioned on the upstream side of the second guide roller 44. The first guide roller 42 and the second guide roller 44 are rotatably supported in a state where outer peripheral surfaces are in contact with the web 4, and rotate by friction with the web 4.

The dancer roller 46 is disposed between the first guide roller 42 and the second guide roller 44, that is, is disposed such that the web 4 comes into contact with the first guide roller 42, the dancer roller 46, and the second guide roller 44 in this order. The dancer roller 46 is supported to be movable in an up-and-down direction in the embodiment.

The actuator device 48 includes an actuator main body 50, a pressure sensor 52, and a position sensor 54.

The actuator main body 50 is an air actuator in the embodiment. The actuator main body 50 has a rod 64. A tip of the rod 64 is connected to the dancer roller 46. The actuator main body 50 is provided such that a direction where the rod 64 extends, that is, a direction where the rod 64 moves matches the up-and-down direction in the embodiment.

The pressure sensor 52 detects a pressure in the actuator main body 50, and outputs the detected value at a predetermined cycle to the control device 100.

The position sensor 54 detects a position of the rod 64, and outputs the detected value at a predetermined cycle to the control device 100.

Figure 3:
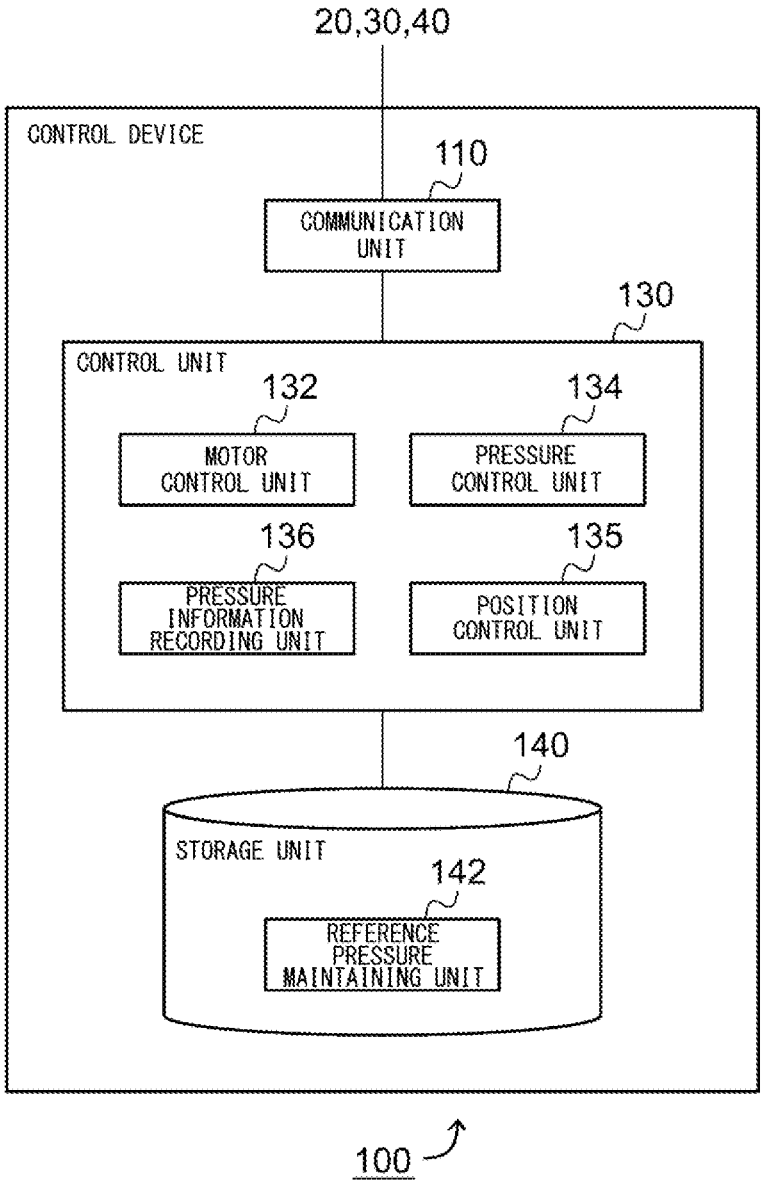
FIG. 3 is a block diagram showing a functional configuration of a control device of FIG. 2.

FIG. 3 is a block diagram showing a functional configuration of the control device 100 of FIG. 2. The control device 100 includes a communication unit 110, a control unit 130, and a storage unit 140.

Each block shown herein can be realized by an element or a mechanical device, including a CPU of a computer, in terms of hardware, and is realized by a computer program in terms of software. Herein, each block is shown as a functional block realized by cooperation between hardware and software. Therefore, it is clear for those skilled in the art that the functional blocks can be realized in various forms in combination with hardware and software.

The communication unit 110 communicates with an external device in accordance with a predetermined communication protocol. For example, the control unit 130 transmits a control signal for controlling a pressure via the communication unit 110.

The control unit 130 includes a motor control unit 132, the pressure control unit 134, the position control unit 135, and the pressure information recording unit 136. The motor control unit 132 synchronization-controls the first plate cylinder 24 and the second plate cylinder 34 based on the output from the first encoder 28 and the second encoder 38.

The pressure control unit 134 controls a pressure in the actuator main body 50 and a force (thrust) applied to the web 4 by the dancer roller 46 via the rod 64. The position control unit 135 controls a position of the rod 64 and a position of the dancer roller 46. In a preparation process of providing the dancer system 40 in the web processing system 102, the position control unit 135 controls the positions of the rod 64 and the dancer roller 46 such that the rod 64 and the dancer roller 46 are kept at a certain position (hereinafter, called a reference position) where moving both up and down is possible, with reference to a detected value from the position sensor 54. Specifically, in the embodiment, the position control unit 135 adjusts a pressure in the actuator main body 50 such that the rod 64 and the dancer roller 46 are kept at the reference position. The reference position may be, for example, an intermediate position in a stroke range of the rod 64. The pressure information recording unit 136 reads a pressure of this time (hereinafter, called a reference pressure) from the pressure sensor 52, and records the pressure in the reference pressure maintaining unit 142 (to be described later).

In addition, in a printing process of actually printing a print pattern onto the web 4 by the web processing system 102 in which the dancer system 40 is provided, the pressure control unit 134 controls a pressure in the actuator main body 50 such that the pressure is kept at the reference pressure, with reference to a detected value from the pressure sensor 52.

The storage unit 140 is a storage area that stores data to be referred to and to be updated by the control unit 130. The storage unit 140 includes the reference pressure maintaining unit 142. The reference pressure maintaining unit 142 maintains the reference pressure.

Figure 4A:
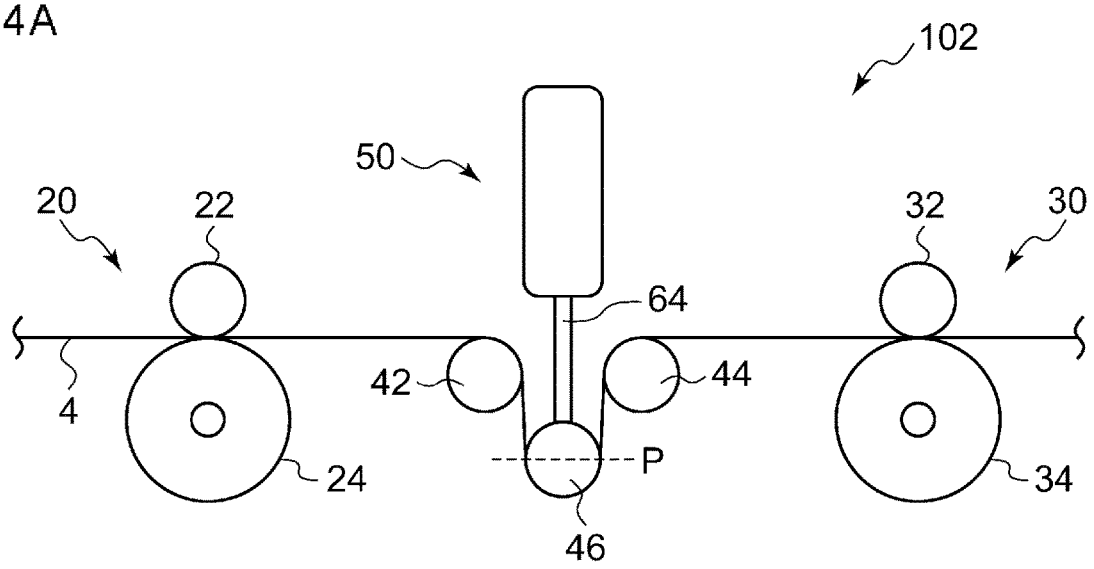
FIGS. 4A and 4B are views illustrating a state of a dancer system in a preparation process and a production process.
Figure 4B:
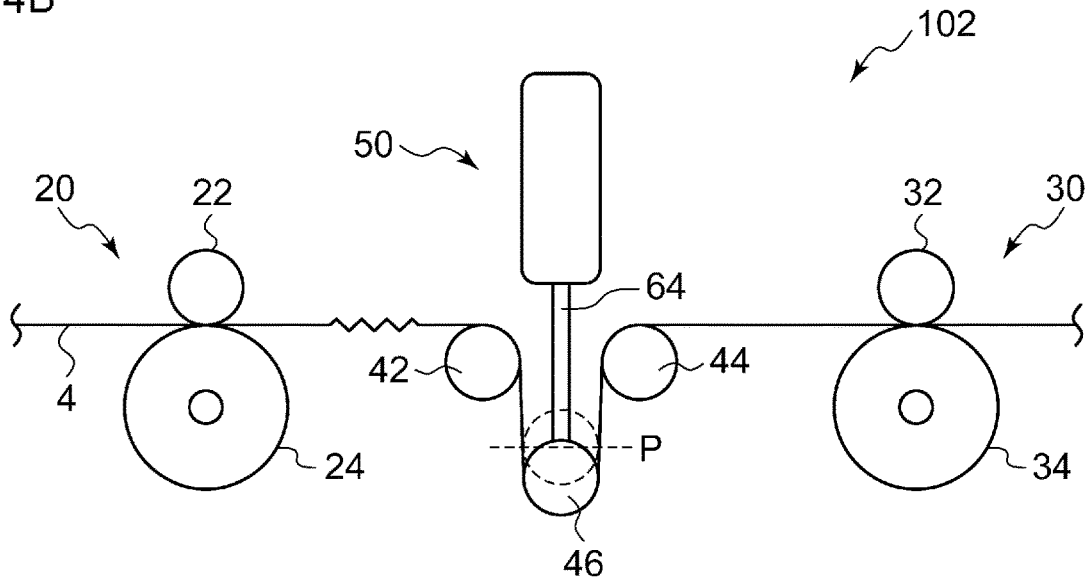

Operation of the web processing system 102 including the dancer system 40 configured as described above will be described. FIGS. 4A and 4Bb are views illustrating a state of the dancer system 40 in the preparation process and a production process.

Preparation Process

As illustrated in FIG. 4A, each roller of the dancer system 40 is provided between the first plate cylinder 24 and the second plate cylinder 34. Next, the position control unit 135 controls the positions of the rod 64 and the dancer roller 46 such that the dancer roller 46 is kept at a reference position P, with reference to a detected value from the position sensor 54. The control device 100 drives a transport roller (not illustrated) to transport the web 4 in a state where the dancer roller 46 is kept at the reference position P. The motor control unit 132 operates the two plate cylinders through phase control, that is, rotates the two plate cylinders at the same phase. The pressure information recording unit 136 reads a pressure in the actuator main body 50 of this time from the pressure sensor 52, and records the pressure in the reference pressure maintaining unit 142 as the reference pressure. The pressure information recording unit 136 may set, for example, an average value in a certain period (for example, for 10 seconds) after the pressure in the actuator main body 50 is stabilized, as the reference pressure.

Since the dancer roller 46 is controlled to be kept at the reference position P, the dancer roller 46 of this time simply functions as a guide roller such as the first guide roller 42 and the second guide roller 44, and the existence of the dancer system 40 does not affect the tension of the web 4 between the plate cylinders. That is, the tension of the web 4 between the plate cylinders is substantially the same as tension in a case where the dancer system 40 does not exist. More specifically, the tension of the web 4 between the plate cylinders is substantially the same as tension (hereinafter, referred to as reference tension) including tension flowed in from a previous section and tension generated due to a property difference between the first plate cylinder 24 and the second plate cylinder 34 (for example, a diameter difference which occurs due to processing accuracy).

Printing Process

The control device 100 drives the transport roller to transport the web 4. The motor control unit 132 operates the two plate cylinders through phase control. Accordingly, print patterns of the two plate cylinders are printed onto the web 4 so as to overlap each other. With reference to a detected value from the pressure sensor 52, the pressure control unit 134 performs control such that a pressure in the actuator main body 50 is kept at the reference pressure maintained by the reference pressure maintaining unit 142, in other words, such that the tension of the web 4 between the two plate cylinders is kept at the reference tension.

Herein, as illustrated in FIG. 4B, for example, when the web 4 flutters due to disturbance such as dry wind for drying an ink of a print pattern printed by the first printing unit 20 and tension variations occur in the web 4 between the plate cylinders, the dancer roller 46 moves in the up-and-down direction and a path length between the two plate cylinders changes. Accordingly, tension variations that occur in the web 4 between the plate cylinders can be suppressed.

In the embodiment described above, the dancer system 40 performs control such that the dancer roller 46 is disposed between the two plate cylinders and the tension of the web 4 between the two plate cylinders is kept at the reference tension.

However, a configuration where the dancer roller of the dancer system is provided between the two rollers and the tension of the web between the two rollers is controlled to be any tension is known as the related art. In the configuration, the dancer roller 46 moves to absorb tension variations that occur in the web 4 between the two rollers. In this case, it is possible to avoid that the dancer roller 46 reaches a boundary of the stroke range thereof by changing a rotation speed of at least one of the two rollers and for example, returning the position of the dancer roller 46 to the intermediate position of the stroke range.

On the contrary, since the two plate cylinders undergo phase control in the embodiment, rotation speeds thereof cannot be changed. That is, it is impossible to avoid that the dancer roller 46 reaches the boundary of the stroke range thereof by changing the rotation speeds of the plate cylinders. As described above, providing the dancer roller of the dancer system between the two plate cylinders which are under phase control is not that simple.

On the contrary, in the embodiment described above, the dancer system 40 performs control such that the tension of the web 4 between the plate cylinders is substantially the same as the reference tension, that is, the tension including the tension flowed in from the previous section and the tension generated due to a property difference between the first plate cylinder 24 and the second plate cylinder 34. Therefore, since a phenomenon in which the dancer roller 46 reaches the boundary of the stroke range does not occur, it is not necessary to change a rotation speed of at least one of the two plate cylinders. Therefore, the dancer roller 46 of the dancer system 40 can be disposed also between the two plate cylinders which are under phase control in the embodiment. Thus, tension variations that occur between the two plate cylinders due to the dancer system 40 are suppressed.

That is, in the embodiment, while rotating the first plate cylinder 24 and the second plate cylinder 34 at the same phase, tension variations of the web 4 therebetween can be suppressed. Therefore, it is possible to realize higher-precision printing.

Hereinbefore, the dancer system according to the embodiment has been described. The embodiment is merely an example, and it is clear for those skilled in the art that various modification examples can be made to a combination of each component and each processing process, and such modification examples are also in the scope of the present invention. Hereinafter, modification examples will be described.

Modification Example 1

Although a case where the first plate cylinder 24 and the second plate cylinder 34 are driven by respective drive motors and undergo phase control is described in the embodiment, the invention is not limited thereto. It is sufficient that the first plate cylinder 24 and the second plate cylinder 34 are configured to rotate at the same phase. For example, by driving the two plate cylinders by one drive motor, the plate cylinders may rotate at the same phase.

Modification Example 2

Although a case where the dancer roller 46 of the dancer system 40 is disposed between the two plate cylinders is described in the embodiment and the modification example described above, the invention is not limited thereto. Also, in a case where the dancer system 40 is disposed between another two rollers under phase control, the technical idea of the embodiment can be applied.

Modification Example 3

Although a case where the printing device is an intaglio printing device is described in the embodiment and the modification examples described above, without being limited thereto, the printing device 10 may be other systems of printing devices such as an offset printing device, and a CI-type or line-type flexographic printing device. In this case, and also in a case where the dancer system 40 is disposed between the two cylinders of the other systems of printing devices, the technical idea of the embodiment can be applied.

Modification Example 4

Although a case where the web processing system 102 is a printing system is described in the embodiment and the modification examples described above, without being limited thereto, the technical idea of the embodiment can also be applied to other types of web processing systems that execute predetermined processing onto the web.

Modification Example 5

Although a case where a direction where the rod 64 and the dancer roller 46 move is the up-and-down direction is described in the embodiment and the modification examples described above, without being limited thereto, the dancer system 40 may be provided to move in other directions. For example, the dancer system 40 may be provided such that the rod 64 and the dancer roller 46 move in a horizontal direction.

Modification Example 6

Although a case where the reference pressure, that is, information related to the reference tension is detected by the dancer system 40 in the preparation process is described in the embodiment, without being limited thereto, the reference pressure and the reference tension may be detected by another tension detector provided between the two rollers. In this case, the reference tension may be detected in a state where the web 4 is transported such that the web does not pass the dancer roller 46 or a state where the dancer roller 46 is mechanically fixed such that the dancer roller does not move. Thus, in the printing process, the dancer roller 46 may apply a pressure in the actuator main body 50 such that a force (thrust) according to the reference tension is applied to the web 4.

Modification Example 7

Although a case where the actuator main body 50 is an air actuator is described in the embodiment and the modification examples described above, the invention is not limited thereto. The actuator main body 50 may be, for example, a hydraulic actuator, an electromagnetic actuator, and other actuators.

Modification Example 8

Although a case where the printing device 10 includes the actuator device 48 is described in the embodiment and the modification examples described above, the invention is not limited thereto. It is sufficient that a force can be applied such that the tension of the web 4 between the plate cylinders is kept at the reference tension. For example, a weight having heaviness corresponding to the reference tension may be hung on the dancer roller 46, instead of the actuator device 48. In this case, the reference tension may be detected by the tension detector, and the heaviness of the weight may be determined based on the detected value.

Any combination of the prerequisite technology, the embodiment, and the modification examples which are described above is also useful as an embodiment of the present invention. A new embodiment generated from combination has respective combined effects of the combined embodiment and modification examples. In addition, it is also clear for those skilled in the art that a function to be fulfilled by each of configuration requirements described in the claims is realized by each of single components or a combination thereof described in the embodiment and the modification examples. For example, two rollers described in the claims may be realized by the first plate cylinder 24 and the second plate cylinder 34.

The present invention can be used in the web processing system and the control method thereof.

It should be understood that the invention is not limited to the above-described embodiment, but may be modified into various forms on the basis of the spirit of the invention. Additionally, the modifications are included in the scope of the invention.

What is claimed is:

1. A high-precision web processing system comprising:

a first roller and a second roller configured to rotate at a same phase while being in contact with a web, which is continuous along a movement passage; and a first drive motor configured to drive the first roller and a second drive motor configured to drive the second roller a suppressing mechanism for suppressing a variation in a tension of the web between the two rollers, the variation in tension arising of the first drive motor and the second drive motor, wherein the suppressing mechanism includes a dancer roller configured to come into contact with the web between the two rollers, wherein the suppression mechanism applies and then maintains a reference pressure to control the position of the dancer roller, and wherein the reference pressure is obtained by detecting a pressure when the dancer roller is maintained at a certain position while in contact with the web while the web is being transported.

2. The high-precision web processing system according to claim 1, wherein the suppressing mechanism is configured such that a path length of the web between the two rollers changes when the tension of the web between the two rollers is varied.

3. The high-precision web processing system according to claim 1, wherein the suppressing mechanism includes:

an actuator that applies a force to the dancer roller; and a control unit that controls the actuator, wherein the control unit controls the actuator to cause the dancer roller be in a position to maintain the reference pressure in the suppressing mechanism.

4. The high-precision web processing system according to claim 1, wherein the suppressing mechanism includes:

a hydraulic actuator having a rod connected to the dancer roller; and a control unit that controls the position of the dancer roller to maintain the reference pressure by controlling the hydraulic actuator, wherein the control unit controls a pressure in the hydraulic actuator to the reference pressure, wherein the reference pressure is obtained by detecting a pressure in the hydraulic actuator when the control unit controls the hydraulic actuator to the dancer roller to be kept at a certain position while the web is being transported.

5. The high-precision web processing system according to claim 1, wherein the tension of the web is continuously adjusted throughout the entire length of the web.

6. A high-precision web processing system comprising:

two rollers configured to rotate at a same phase while being in contact with a web which is continuous along a movement passage; and a suppressing mechanism for suppressing a variation in a tension of the web between the two rollers, the variation in tension arising due to wind disturbances, wherein the suppressing mechanism includes a dancer roller configured to come into contact with the web between the two rollers, wherein the suppression mechanism applies and then maintains a reference pressure to control the position of the dancer roller, and wherein the reference pressure is obtained by detecting a pressure when the dancer roller is maintained at a certain position while in contact with the web while the web is being transported.

7. A control method of a web processing system including two rollers that are configured to rotate at the same phase while being in contact with a web which is continuous along a movement passage; and a dancer system that includes:

a dancer roller disposed between the two rollers, an actuator with a rod, a tip of the rod is connected to the dancer roller, a position sensor that detects a position of the rod, a pressure sensor that detects a pressure in the actuator, and a control unit;

the method comprising:

first, controlling the rod to maintain a certain position based on a detected value from the position sensor, wherein the control unit records the pressure detected by the pressure sensor as a reference pressure; and second, the control unit controls the actuator to maintain the reference pressure, with reference to a detected value from the pressure sensor.

* * * * *